United States Patent [19]

Halgrimson et al.

[11] 4,412,297

[45] Oct. 25, 1983

[54] ULTRASONIC LOG SCANNING AND ORIENTATION SYSTEM

[75] Inventors: Darrell N. Halgrimson, Edmonds; Donald H. Hanson, Arlington; Richard T. King, Mountlake Terrace, all of Wash.

[73] Assignee: Black Clawson, Inc., Everett, Wash.

[21] Appl. No.: 193,980

[22] Filed: Oct. 6, 1980

[51] Int. Cl.[3] ..... B27B 1/00

[52] U.S. Cl. ..... 364/559; 144/209 A; 367/96

[58] Field of Search ..... 364/559–561, 364/507; 367/96, 99; 144/209 A, 209 R

[56] References Cited

U.S. PATENT DOCUMENTS

| | | | |
|---|---|---|---|
| 3,037,538 | 6/1962 | Graham | 144/209 |
| 3,513,321 | 5/1970 | Sherman | 250/219 |
| 3,736,968 | 6/1973 | Mason | 144/312 |
| 3,746,065 | 7/1973 | Mason | 144/309 |
| 3,806,253 | 4/1974 | Denton | 356/157 |
| 3,852,579 | 12/1974 | Sohn et al. | 364/561 |
| 3,902,539 | 9/1975 | Kettelev | 144/209 |
| 3,992,615 | 11/1976 | Bennett et al. | 364/561 |
| 3,996,791 | 12/1976 | Niklas et al. | 364/507 |
| 3,996,792 | 12/1976 | Kubota et al. | 364/507 |
| 4,139,035 | 2/1979 | Bystedt et al. | 144/312 |
| 4,152,767 | 5/1979 | Laliotis | 364/560 |
| 4,173,788 | 11/1979 | Laliotis | 364/560 |
| 4,197,888 | 4/1980 | McGee et al. | 144/209 |
| 4,356,850 | 11/1982 | Halgrimson et al. | 367/96 |

*Primary Examiner*—Gary Chin

*Attorney, Agent, or Firm*—Biebel, French & Nauman

[57] ABSTRACT

A device and method of orienting a log in a veneer lathe charger to produce optimum positioning of the log in a veneer lathe when the log is loaded into the lathe by the charger includes a plurality of ultrasonic transducers which are positioned circumferentially and longitudinally about the log periphery. The ultrasonic transducers sense the position of the log and the log is re-oriented, under control of a computer which receives the outputs from the transducers, prior to loading the log into the veneer lathe.

14 Claims, 5 Drawing Figures

ULTRASONIC LOG SCANNING AND ORIENTATION SYSTEM

BACKGROUND OF THE INVENTION

The present invention is directed to a device and method for determining the surface configuration of a log in a charger of the type which supplies logs to a veneer lathe. The device and method of the present invention provide for orienting the log such that an optimum longitudinal axis of the log is aligned with the lathe spindles of the veneer lathe when the log is supplied to the lathe. More particularly, the present invention is directed to such a device and method which utilize ultrasonic scanning of the log.

In processing logs into veneer, standard length logs, termed peeler blocks, are received by a charger device associated with the veneer lathe. The charger then loads the log into the lathe where it is peeled into a strip of veneer. In a number of prior art charger systems, alignment of the block is accomplished under control of an operator and, as a result, substantial errors may be made by the operator in locating the optimum spin axis for rotation of the block in the lathe. Since the size and surface contour of logs varies substantially, it is not possible for an operator to determine consistently and accurately the optimum spin axis, especially since logs must be loaded into the veneer lathe in succession at a relatively high rate.

In order to increase the accuracy with which logs are positioned in a veneer lathe, a number of charger systems have been devised which provide for approximate mechanical centering of a log in the log charger, prior to loading the log into the lathe. In one such system manufactured by Durand Machine Co., Ltd., New West Minster, British Columbia, Canada, the log is supplied to a set works consisting of a pair of vertically movable members defining V-shaped surfaces which cradle the log. The log is then raised by the set works while, simultaneously, feeler arms are lowered. When the arms contact the top of the log, movement of the set works is terminated and the log is assumed to be substantially aligned with a fixed axis of the charger. A pair of carrying arms then engage opposite ends of the log and carry the log into position in the veneer lathe.

In another mechanical charger arrangement, manufactured by Coe Manufacturing Company, Painesville, Ohio, a pair of support arms are provided, each arm having three log engaging members mounted thereon which press against three sides of the log. By means of a mechanical linkage arrangement interconnecting the members, the members move the log into a position substantially aligned with a fixed axis of the charger. Thereafter, the support arms are pivoted and carry the log into position in the veneer lathe. At best, the Durand and Coe charger systems only approximately center the logs, since these systems do not take into account any variations in the logs which exist between the points at which the logs are mechanically engaged.

A number of veneer lathe charger systems have been developed in which the contour of the surface of a log and the radius or diameter of the log at a number of points along its length are monitored in order to determine the optimum alignment of the log with respect to the veneer lathe rotational axis. Generally, such systems have utilized photo-optical scanning of a log to determine its shape and surface contour. U.S. Pat. No. 3,852,579, issued Dec. 3, 1974, to Sohn et al. and U.S.

Pat. No. 3,992,615, issued Nov. 16, 1976, to Bennett et al., disclose electro-optical ranging systems in which light directed from a light source to strike the log surface is reflected from the surface to a photo-electric detector. The light from the light source is modulated in such a manner that the distance from the source and detector to log surface may be measured. The log is rotated during this optical scanning operation. By subtracting the measured distance from the light source and detector to the log surface from the known distance between the light source and detector and the axis of rotation of the log, the radii of the log at a number of angularly spaced positions around the log periphery are determined. This information is then utilized by a computer to determine the optimum rotational axis for the log in the veneer lathe.

In U.S. Pat. No. 3,902,539, issued Sept. 2, 1975, to Ketteler, a device is disclosed for centering the longitudinal axis of a log in which two set works members defining V-shaped log cradling surfaces are raised until the upper surface of the log breaks several beams of light. The beams extend tangentially with respect to the upper surface of the log in an inverted V-shape. The set works may be adjusted, both vertically and horizontally to center the log with respect to a fixed axis.

Finally, U.S. Pat. No. 4,197,888, issued Apr. 15, 1980, to McGee et al., discloses a log centering device, generally of the type described above with respect to the mechanical centering charger manufactured by Coe Manufacturing Company. The disclosed log centering device, however, includes a plurality of light sources which project tangential beams of light adjacent the periphery of the log as the log is rotated on a spindle arrangement in the charger, subsequent to an approximate mechanical centering operation. The log is then regripped by the log engaging members on the support arms and its position is adjusted by movement of the members. Finally, a separate pair of arms engage opposite ends of the log and pivot the log into position in the veneer lathe.

It will be appreciated that the above described prior art devices are not suitable for retrofitting onto existing chargers of the type which geometrically center logs in mechanical operation. A number of the above described devices require an additional spindle arrangement in the charger for rotating the logs during the scanning operation. Also, the charging process is slowed by the need to rotate the logs in the charger during scanning. Finally, photo-optical scanning, utilizing one or more beams of light which are directed tangentially with respect to a log, does not provide a completely accurate representation of variations in the log radius.

It is seen, therefore, that there is a need for a simple, accurate device for orienting a log in a veneer lathe charger, prior to loading the log into the lathe, in which accurate measurements of the variations in the log surface may be made and which is suitable for retrofitting on existing veneer lathe chargers.

SUMMARY OF THE INVENTION

A device for orienting a log with respect to the axis of rotation of a veneer lathe prior to supplying the log to the veneer lathe includes support means for supporting a log and positioning means for adjusting the position of the support means. Ultrasonic transducer means are provided for sensing the position of the log supported by the support means to determine the orientation of the log for optimum operation of the veneer lathe. A control means, responsive to the ultrasonic transducer means, controls the positioning means to orient the log with respect to the axis of rotation of the veneer lathe.

The ultrasonic transducer means may comprise a plurality of groups of ultrasonic transducers, with the groups being spaced apart along the length of the log and with each such group including a plurality of ultrasonic transducers positioned circumferentially about the log for sensing the surface of the log at points spaced circumferentially therearound. Each of the transducers groups may comprise at least five transducers.

The support means may comprise a pair of support arms, each arm having a plurality of log engaging members mounted thereon. The support arms may be pivotable from a positioning station, in which the log is scanned by the ultrasonic transducer means, to a lathe loading position, in which the log is supplied to the veneer lathe. The positioning means may include adjustable pivot means for adjusting the points about which the support arms pivot, whereby the rotation of the arms to the lathe loading position is controlled. Alternatively, the support means may comprise a pair of log cradling members, each of the members defining a V-shaped log supporting surface. The positioning means for adjusting the position of the support means may comprise means for adjusting the position of the log cradling members in two directions.

The present invention further relates to a method of positioning a log prior to loading the log into a veneer lathe, comprising the steps of:

(a) supporting the log adjacent a reference axis defined by the veneer lathe spindles, (b) scanning the log surface at a plurality of positions circumferentially around and longitudinally along the length of the log by means of a plurality of ultrasonic transducers, (c) determining from the outputs of the transducers the longitudinal axis of the log for optimum production of veneer by means of the veneer lathe, and the re-orientation of the log necessary to align such longitudinal axis with a reference axis, (d) repositioning the log such that the longitudinal axis is aligned with the reference axis, and (e) rescanning the log surface with the ultrasonic transducers to assure that the log is properly repositioned.

The method may be practiced in a veneer lathe charger in which the log is subsequently transferred to the veneer lathe, with the optimum longitudinal axis of the log aligned with the axis of rotation of the lathe.

Accordingly, it is an object of the present invention to provide a device and method for scanning a log surface by means of ultrasonic transducers and for re-orienting the log prior to supplying the log to a veneer lathe; to provide such a device and method in which a plurality of groups of ultrasonic transducers are spaced apart along the length of the log, with transducers in each of the groups being circumferentially spaced around the log periphery; to provide such a device and method in which scanning is accomplished prior to and subsequent to orientation of the log; to provide such a device and method which is compatible with known mechanical centering veneer lathe chargers for retrofitting such chargers; and to provide such a device and method in which scanning and re-orientation may be accomplished simply, accurately, and rapidly.

DETAILED DESCRIPTION OF THE PREFERRED EMBODIMENT

Figure 1:
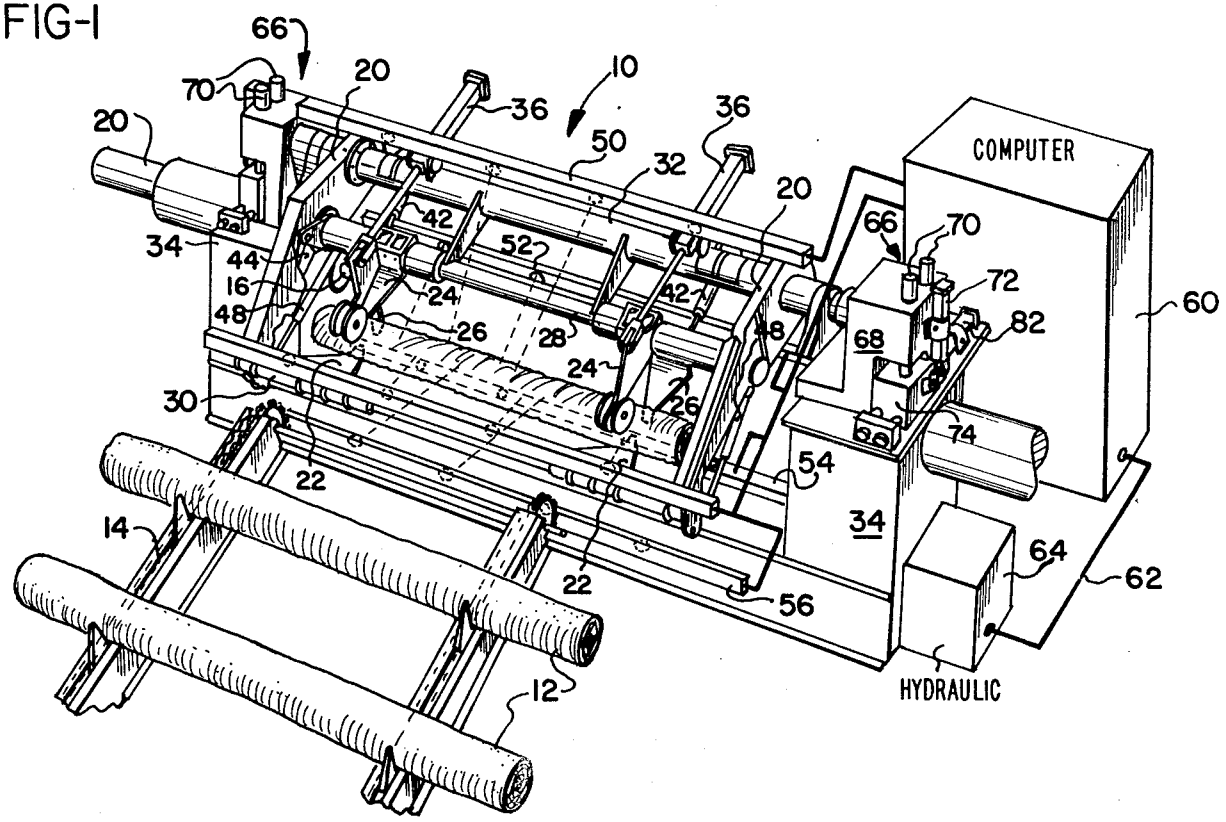
FIG. 1 is a perspective view, illustrating the device of the present invention in conjunction with a first type of veneer lathe charger.
Figure 2:
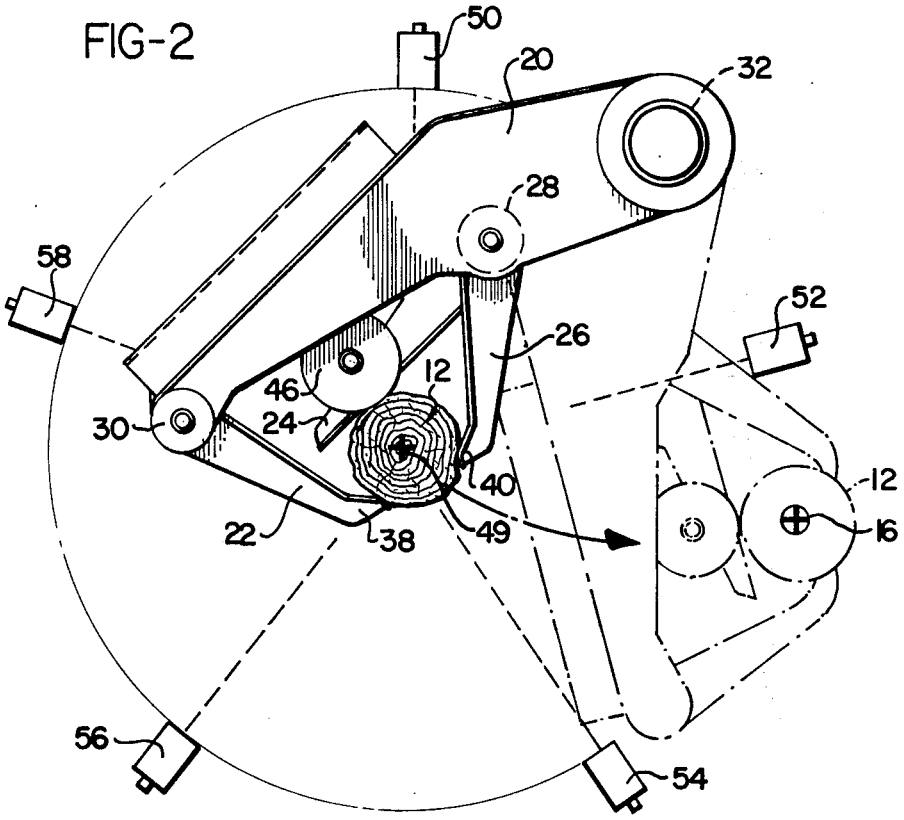
FIG. 2 is a diagrammatic side view, illustrating the position of the ultrasonic transducers and pivoting of the charger support arms in the charger of FIG. 1.

Reference is made to FIGS. 1 and 2 which illustrate the present invention in conjunction with a veneer lathe charger of the type manufactured by The Coe Manufacturing Company, Painesville, Ohio. The charger 10 receives a succession of logs or peeler blocks 12 from a chain conveyor 14 and presents them for engagement by the spindle 16 of veneer lathe 18. As a log mounted on spindle 16 is rotated by a spindle drive mechanism, including motor 20, a sheet of veneer is peeled from the log periphery by a lathe knife edge (not shown) which slowly moves inward, in a known manner.

It may be helpful to consider the manner in which the Coe charger would operate prior to retrofitting according to the present invention. The charger 10 includes a pair of support arms 20. As seen most clearly in FIG. 2, each support arm 20 has a plurality of log engaging members 22, 24, and 26 pivotally mounted thereon. Members 24 and 26 pivot about support shaft 28, extending between arms 20, while members 22 pivot about support shaft 30, extending between the lower ends of support arms 20. In the unmodified Coe charger, arms 20 pivot on support shaft 32 which is rotatably secured to the end frame supports 34 of the veneer lathe. Log engaging members 24 are initially raised upward by means of hydraulic cylinders 36, which are secured to shaft 32. A log 12 from the conveyor 14 is received by log engaging members 22 and 26 which have previously been pivoted such that their lower ends 38 and 40 are nearly touching. Cylinders 42 provide a substantially constant torque to members 26, urging them clockwise as seen in FIG. 2. This torque is transmitted to the members 22 by means of linkages 44, which extend within the arms 20 from members 26 to members 22, so as to produce counterclockwise rotation of members 22. Next, members 24 are lowered by means of cylinders 36, pressing wheels 46 downward against the log 12, and overcoming the force provided by cylinders 42. This forces the ends 38 and 40 of log engaging members 22 and 26 gradually apart. The downward movement of member 24 and spreading of members 22 and 26 is terminated by sliding stop lengths 48, extending between the members 22 and the members 24, in such a manner that the log 12 is approximately geometrically centered, regardless of the radius of the log. The log is now positioned with respect to a fixed axis 49 of the charger. Subsequently, the support arms 20 are pivoted by means of hydraulic cylinders (not shown) into the position illustrated in dashed lines in FIG. 2 such that the log 12 may be engaged by the chucks or spindles 16 of the veneer lathe and is appropriately aligned with respect to a reference rotation axis defined by the spindles.

It will be appreciated that this mechanical geometric centering process is not precise since it assumes a perfectly straight log of circular cross-section. In order to determine more precisely the surface contour of a log and to orient the log in a manner in the lathe which produces an optimum output of veneer, the present invention includes a plurality of ultrasonic transducers. A bank of transducers 50 is positioned directly above the charger; a bank of transducers 52 is positioned above the log 12 in the charger and rearward of the log; a bank of transducers 54 is positioned below the charger and rearward of the log 12; a bank of transducers 56 is positioned below the charger and forward of the log 12; and a bank of transducers 58 is positioned slightly above and forward of the log 12. As seen in FIG. 2, banks 50–58 of transducers are positioned around the periphery of the log when it is held by the log engaging members 22, 24, and 26. Each bank of ultrasonic transducers includes four separate transducers which are spaced along the length of the log for sensing the log surface while the log is supported by arms 20.

The ultrasonic transducers in banks 50–58 are grouped in a plurality of groups which are spaced along the length of the log 12. Each group of transducers encircles log 12 so that five points on the log circumference may be determined by the transducers in the group. Each transducer in the group directs ultrasonic bursts toward the log at an associated one of the points. The bursts of ultrasonic energy are reflected from the log surface and are received by the transducers from which they emanated. The time period required for an ultrasonic burst to travel from a transducer to the surface of the log, be reflected by the surface, and return to the transducer is a function of the distance from the transducer to the log surface.

In operation, a log 12 is initially supplied to the charger by conveyor 14. The log is then approximately centered by operation of members 22, 24, and 26, as described above. The surface of the log is scanned by means of the ultrasonic transducers to determine the surface contour.

Operation of the transducers is controlled by a computer 60 through an interface circuit which may be of the type shown in copending U.S. Pat. application Ser. No. 191,884 now U.S. Pat. No. 4,356,850. The computer 60 receives output signals from the ultrasonic transducers and, in response, determines the optimum orientation of the log 12 which is to be inserted in the lathe 18. Computer 60 then provides an output control signal on line 62 to hydraulic controller 64 for control of a pair of set works 66 which support shaft 32. As described more completely below, set works 62 independently adjust the vertical and horizontal position of each end of the shaft 32 such that, when the arms 20 are pivoted into the lathe loading position shown in dashed lines in FIG. 2, the log 12 is engaged by spindles 16 in the optimum orientation. Computer 60 may be any one of a number of known computer control systems for determining optimum log orientation, such as for instance the control systems shown in U.S. Pat. No. 3,852,579, issued Dec. 3, 1974, to Sohn et al., or U.S. Pat. No. 4,197,888, issued Apr. 15, 1980, to McGee et al. Prior to pivoting arms 20, however, it is desirable that a second surface scanning operation be performed with the ultrasonic transducers to insure that the log has in fact been re-oriented. If desired, scanning can be effected continuously during re-orientation to provide a feed back control path to the computer for controlling the re-orientation process.

Figure 3:
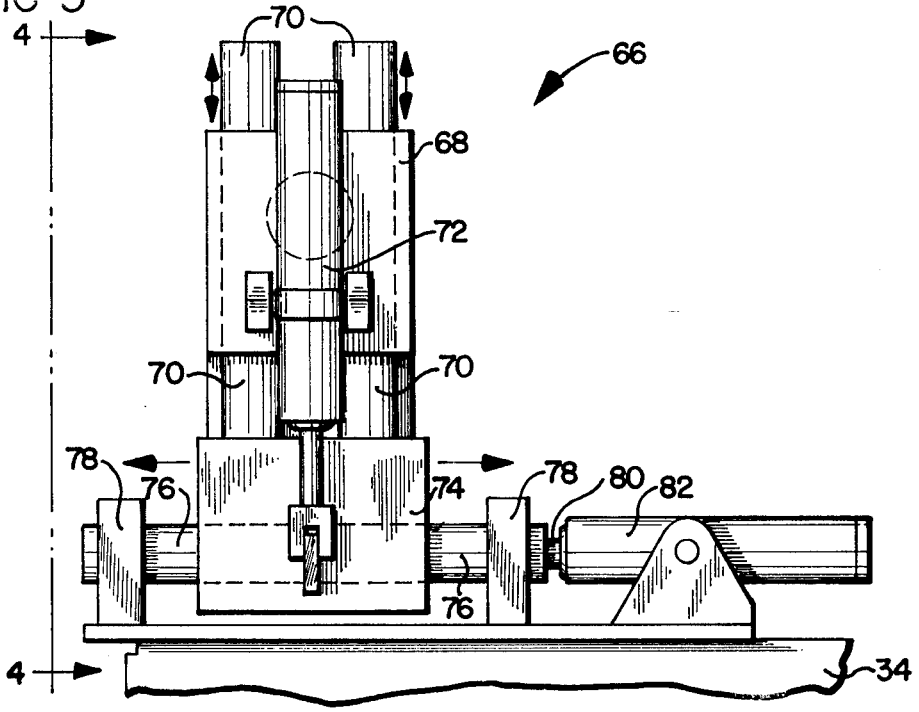
FIG. 3 is an enlarged view of a set works for adjusting the points about which the support arms of the charger of FIG. 1 pivot, as seen looking generally right to left in FIG. 1.
Figure 4:
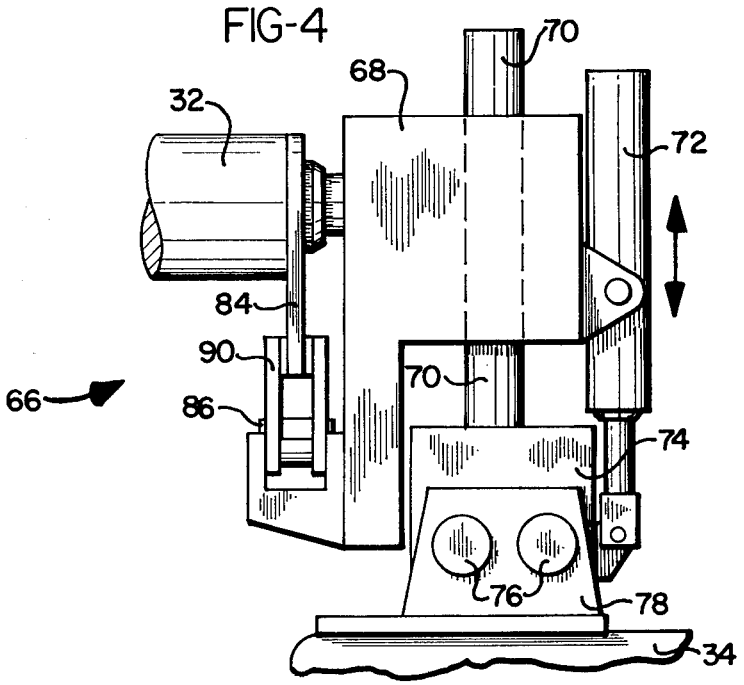
FIG. 4 is an enlarged view of the set works of FIG. 3, taken generally along line 4—4 in FIG. 3.

FIGS. 3 and 4 illustrate the set works 66 at one end of the shaft 32 in greater detail, it being understood that the set works at each end of the shaft 32 are identical. Set works 66 provides a means for adjusting the position of shaft 32 both vertically and horizontally. Shaft 32 is rotatably supported in upper support block 68 by means of appropriate bearings. Block 68 is vertically slidable on vertical shafts 70 which extend therethrough, with the vertical position of block 68 being controlled by means of vertical cylinder 72 extending between upper support block 68 and lower support block 74. Block 74 supports vertical shafts 70 and is itself horizontally slidable on shafts 76 which extend between fixed shaft supports 78. The shaft 80 of hydraulic cylinder 82 extends through a support 78 and engages lower block 74.

It will be seen that support block 68 may be raised and lowered by cylinder 72. Actuation of hydraulic cylinder 82 results in horizontal movement of both upper and lower support blocks 68 and block 74. As a consequence, by actuation of hydraulic cylinders 72 and 82, the position of each end of the shaft 32 may be independently adjusted to provide for proper orientation of the log 12 as it is moved into position in the veneer lathe 18. Arm 84 is attached to shaft 32 and engages hydraulic cylinder 86 via linkage 90. Actuation of cylinder 86 results in pivoting shaft 32 and rotation of arms 20 into the desired positions for scanning and loading a log.

Figure 5:
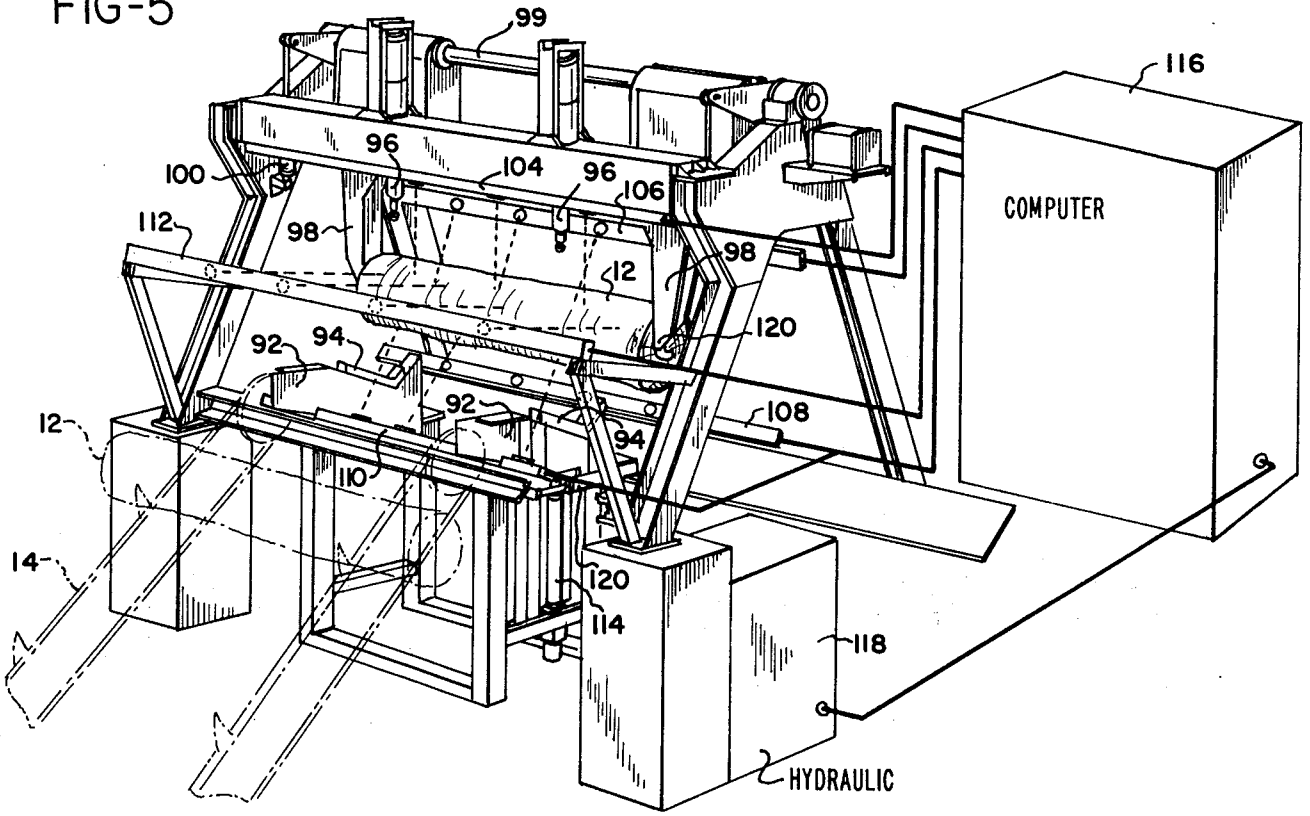
FIG. 5 is a perspective view, similar to FIG. 1, illustrating the device of the present invention in conjunction with a second type of veneer lathe charger.

Reference is now made to FIG. 5 which illustrates the present invention in conjunction with a charger of the type manufactured by Durand Machine Co., Ltd., New West Minster, British Columbia, Canada. Although not illustrated in this drawing, the veneer lathe is positioned directly behind the charger. The Durand charger in its nonretrofitted form includes a set works having a pair of log cradling members 92, each of which defines a V-shaped log supporting surface 94. The log cradling members 92 receive a log from conveyor 14 and are thereafter raised at a fixed rate by means of appropriate hydraulic cylinders. Simultaneously, a pair of feeler rods 96 move downward toward the log at the same fixed rate of speed. When the rods 96 contact the upper log surface, the log is assumed to be geometrically centered with respect to a fixed axis of the charger.

Thereafter, a pair of log engaging arms 98 on support shaft 99 are pivoted by cylinders 100 into a position in which the arms 98 may engage opposite ends of the log. The arms 98 are then moved inward by a hydraulic mechanism such that they firmly engage the opposite ends of the log. For this purpose, the inner surfaces of arms 98 define one or more inwardly extending sharp edges which pierce the ends of the log. The rods 96 are raised and the members 92 are lowered such that the arms 98 may be pivoted rearwardly, bringing the log into a loading position in the veneer lathe. The path of movement of the arms 98 subsequent to engagement of each log does not vary during each successive charging operation. All adjustment or orientation of the log 12 occurs while the log is supported by the log cradling members 92.

When the Durand charger shown in FIG. 5 is retrofitted according to the present invention, five banks of ultrasonic transducers 104, 106, 108, 110, and 112 are oriented about the periphery of the log in a manner similar to that illustrated in FIG. 2 with respect to the Coe charger. The log 12 is supplied to the log cradling members 92 by the conveyor 14 and is initially mechanically geometrically centered by raising the members 92 with a pair of hydraulic cylinders 114. Simultaneously, feeler rods 96 are lowered until contact is made with the upper surface of the log 12. A scanning operation is then initiated by computer control 116 in which the contour of the log surface is determined by the ultrasonic transducers by transmitting ultrasonic bursts against the log surface and detecting burst reflections therefrom. Computer 116 then determines any additional adjustment or re-orientation of the log 12 which is required to align the longitudinal axis of the log 12 with a fixed axis determined by the points at which arms 98 will engage the log. Computer 116 provides an appropriate control signal to hydraulic controller 118. Each end of the log 12 is re-oriented by raising or lowering the cradle members 92 with hydraulic cylinders 114 and horizontally shifting the cradle members 92 with hydraulic cylinders 120.

Next, the ultrasonic transducers perform a rescanning operation to ensure that the log 12 has been properly re-oriented. As described previously, if desired, scanning can be performed continuously during the re-orientation process. Finally, the arms 98 are pivoted and moved inward into engagement with the ends of the log 12, and the rods 96 and cradle members 92 are withdrawn from the log. The arms 98 are pivoted to bring the log 12 into the proper position in the veneer lathe. It should be noted that each of the arms 98 defines a C-shaped cutout which permits the veneer lathe spindles to be moved inward to engage the ends of the log 12 prior to disengaging the arms 98 therefrom.

It will be appreciated that the speed of sound through air varies in dependence upon the temperature, pressure, and density of the air. As a consequence, circuitry may be provided to compensate for such fluxuations and provide accurate measurements of the surface contour of a log.

It will be appreciated that the present invention lends itself to retrofitting existing veneer lathe chargers of the type which previously performed only a mechanical geometric centering of the logs. With respect to the charger arrangement shown in FIG. 1, the operation of the charger is unaffected by retrofitting with the exception that the pivot points for shaft 32, upon which support arms 20 are mounted, are adjusted by means of set works 66. Similarly, the charging operation in the charger of FIG. 5 is unaffected by retrofitting, with the exception that provision is made for adjustment of the log cradling members 92, both vertically and horizontally, prior to engagement of a log with arms 98. A minimum of additional structure is required for retrofitting the chargers while, at the same time, substantially improved orientation of logs in the veneer lathe is obtained resulting in a corresponding improvement in the amount of usable veneer produced by the lathe.

While the method herein described, and the form of apparatus for carrying this method into effect, constitute preferred embodiments of the invention, it is to be understood that the invention is not limited to this precise method and form of apparatus, and that changes may be made in either without departing from the scope of the invention.

What is claimed is:

1. In a device for orienting a log with respect to the axis of rotation of a veneer lathe prior to supplying the log to the veneer lathe, including support means for supporting a log, positioning means for adjusting the position of said support means, transducer means for sensing the position of a log supported by said support means to determine the orientation of the log for optimum operation of said veneer lathe, and control means, responsive to said transducer means, for controlling said positioning means to orient the log with respect to the axis of rotation of said veneer lathe, the improvement wherein said transducer means comprises;

a plurality of groups of ultrasonic transducers, said groups being spaced apart along the length of the log, and each such group including a plurality of ultrasonic transducers positioned circumferentially about said log for sensing the surface of the log at points spaced circumferentially therearound.

2. The device of claim 1 in which each of said transducer groups comprises at least five transducers.

3. The device of claim 1 in which said support means comprises a pair of support arms, each arm having a plurality of log engaging members mounted thereon, said support arms being pivotable from a positioning station in which the log is scanned by said ultrasonic transducers to a lathe loading position in which the log is supplied to the veneer lathe.

4. The device of claim 3 in which said positioning means for adjusting the position of said support means comprises adjustable pivot means for adjusting the points about which said support arms pivot, whereby the rotation of said arms to said lathe loading position is controlled.

5. The device of claim 1 in which said ultrasonic transducers each provide an electrical signal corresponding to the distance between said transducer and the surface of said log adjacent thereto.

6. The device of claim 1 in which said support means comprises a pair of log cradling members, each of said members defining a V-shaped log supporting surface.

7. The device of claim 6 in which said positioning means for adjusting the position of said support means comprises means for adjusting the position of said log cradling members in two directions.

8. A method of positioning a log prior to loading the log into a veneer lathe, comprising the steps of:

supporting the log adjacent a reference axis defined by the veneer lathe spindles, scanning the log surface at a plurality of positions circumferentially around and longitudinally along the length of the log by means of a plurality of ultrasonic transducers, determining from the outputs of the transducers the longitudinal axis of the log for optimum production of veneer by means of the veneer lathe and the re-orientation of the log necessary to align such longitudinal axis with a reference axis, repositioning the log such that the longitudinal axis is aligned with the reference axis, and rescanning the log surface with said ultrasonic transducers to assure that the log is properly repositioned.

9. The method of claim 8 further comprising the step of moving the log from said repositioned location into said veneer lathe, whereby said lathe is properly charged with said log in an optimum orientation thereof.

10. The method of claim 8 in which the step of scanning the log surface comprises the step of scanning the log surface at a plurality of groups of points, said groups being spaced longitudinally along said log and the points within each of said groups being spaced circumferentially around said log.

11. The method of claim 10 in which the step of scanning the log surface includes scanning the surface of the log at at least five points in each of said groups of points.

12. The method of claim 8 in which the step of scanning the log surface includes the step of maintaining the log stationary during scanning.

13. A method of orienting a log in a veneer lathe charger with respect to a fixed axis to produce optimum positioning of the log in a veneer lathe when the log is loaded into the lathe by the charger, comprising:

orienting the log in substantial alignment with respect to the fixed axis of the charger, scanning the log surface with a plurality of circumferentially and longitudinally displaced ultrasonic transducers to determine the log surface contour, both circumferentially and longitudinally along the log, determining the optimum longitudinal axis of the log for alignment with the rotational axis of the veneer lathe, re-orienting the log such that its optimum longitudinal axis is aligned with the fixed axis of the charger, scanning the log surface at a plurality of positions displaced circumferentially and longitudinally along the log to ensure proper re-orientation of the log, and operating the charger such that the log is transferred into the veneer lathe with the optimum longitudinal axis aligned with the axis of rotation of the lathe.

14. The method of claim 13 in which said steps of scanning the log surface each comprises the step of scanning the log surface at at least five circumferentially displaced positions around the log periphery at each of at least four locations displaced longitudinally along the length of the log.

* * * * *